US010947093B2

(12) United States Patent
Hayashi et al.

(10) Patent No.: US 10,947,093 B2
(45) Date of Patent: Mar. 16, 2021

(54) REMOTE OPERATION TERMINAL AND REMOTE OPERATION SYSTEM OF MOBILE CRANE

(71) Applicant: TADANO LTD., Kagawa (JP)

(72) Inventors: Hiroyuki Hayashi, Kagawa (JP); Masato Miyoshi, Kagawa (JP)

(73) Assignee: TADANO LTD., Kagawa (JP)

( * ) Notice: Subject to any disclaimer, the term of this patent is extended or adjusted under 35 U.S.C. 154(b) by 111 days.

(21) Appl. No.: 16/072,346

(22) PCT Filed: Feb. 2, 2017

(86) PCT No.: PCT/JP2017/003829
§ 371 (c)(1),
(2) Date: Jul. 24, 2018

(87) PCT Pub. No.: WO2017/135382
PCT Pub. Date: Aug. 10, 2017

(65) Prior Publication Data

US 2019/0031475 A1 Jan. 31, 2019

(30) Foreign Application Priority Data

Feb. 3, 2016 (JP) ..... JP2016-019232

(51) Int. Cl.
*B66C 13/40* (2006.01)
*B66C 23/90* (2006.01)
(Continued)

(52) U.S. Cl.
CPC ..... *B66C 13/40* (2013.01); *B66C 23/78* (2013.01); *B66C 23/90* (2013.01); *B66C 23/36* (2013.01)

(58) Field of Classification Search
CPC ..... B66C 13/40; B66C 23/78; B66C 23/90; B66C 23/36
(Continued)

(56) References Cited

U.S. PATENT DOCUMENTS 5,645,181 A * 7/1997 Ichiba ..... B66C 13/46 212/281

FOREIGN PATENT DOCUMENTS

JP S57-174483 U 11/1982
JP H03-025489 U 3/1991
(Continued)

OTHER PUBLICATIONS

Sep. 18, 2019, European Search Report issued for related EP Application No. 17747533.2.
(Continued)

*Primary Examiner* — Maceeh Anwari
(74) *Attorney, Agent, or Firm* — Paratus Law Group, PLLC

(57) ABSTRACT

A remote operation terminal T for remotely operating a mobile crane C is configured to include: a mode selection unit 34 for selecting an operation mode corresponding to work of the mobile crane C from a plurality of operation modes; an operation unit 35, 36 for instructing the mobile crane C on operation; and a control unit T1 that, when the operation mode is selected by the mode selection unit 34, assigns the operation corresponding to the selected operation mode to the operation unit 35, 36, and transmits an operation signal from the operation unit 35, 36 to the mobile crane C. Thereby, various operations can be performed by remote operation while securing safety.

9 Claims, 4 Drawing Sheets

(51) Int. Cl.
*B66C 23/78* (2006.01)
*B66C 23/36* (2006.01)

(58) Field of Classification Search
USPC ..... 701/2
See application file for complete search history.

(56) References Cited

FOREIGN PATENT DOCUMENTS

| | | | | |
|---|---|---|---|---|
| JP | H03-267298 | A | | 11/1991 |
| JP | H08-091780 | A | | 4/1996 |
| JP | H11-255015 | A | | 9/1999 |
| JP | 2000-296985 | A | | 10/2000 |
| JP | 2000296985 | A | * | 10/2000 |
| JP | 2014-222795 | A | | 11/2014 |
| JP | 2014222795 | A | * | 11/2014 |

OTHER PUBLICATIONS

May 9, 2017, International Search Report issued for related PCT application No. PCT/JP2017/003829.
May 9, 2017, International Search Opinion issued for related PCT application No. PCT/JP2017/003829.

* cited by examiner

REMOTE OPERATION TERMINAL AND REMOTE OPERATION SYSTEM OF MOBILE CRANE

CROSS REFERENCE TO PRIOR APPLICATION

This application is a National Stage Patent Application of PCT International Patent Application No. PCT/JP2017/003829 (filed on Feb. 2, 2017) under 35 U.S.C. § 371, which claims priority to Japanese Patent Application No. 2016-019232 (filed on Feb. 3, 2016), which are all hereby incorporated by reference in their entirety.

TECHNICAL FIELD

The present invention relates to a remote operation terminal for remotely operating a mobile crane and a remote operation system of the mobile crane.

BACKGROUND ART

A worker of a mobile crane performs preparation works such as installation of a floor board, overhanging of an outrigger, and overhanging of a jib before performing a suspended loading work. Also, after performing the suspended loading work, the worker performs tidying works such as storage of the jib, storage of the outrigger, and tidying up the floor board.

For preparation work and tidying work, work in the vicinity of an outrigger and a jib and crane operation in a cab are necessary. For this reason, when preparation or tidying work is performed by one worker, the worker needs to go back and forth between inside and outside the cab, resulting in poor work efficiency.

Patent Literature 1 discloses a remote operation device that enables remote operation of a crane when the crane is in a no-load state. When the jib overhangs and is stored, the crane is in the no-load state. Therefore, the crane can be operated by a remote operation means. That is, the overhanging and storage work of the jib can be performed by one worker.

CITATION LIST

Patent Literature

Patent Literature 1: JP 3-25489 U

SUMMARY OF THE INVENTION

Problems to be Solved by the Invention

However, with the technique of Patent Literature 1, the crane can be remotely operated only when the crane is in the no-load state. Therefore, with the technique of Patent Literature 1, various operations other than overhanging and storage of the jib cannot be performed by remote operation.

In view of the above circumstances, an object of the present invention is to provide a remote operation terminal and a remote operation system of a mobile crane, capable of performing various works of the mobile crane by remote operation while securing safety.

Solutions to Problems

An invention related to a remote operation terminal according to the present invention is a remote operation terminal for remotely operating a mobile crane, including: a mode selection unit that can select an operation mode corresponding to work of the mobile crane from a plurality of operation modes; an operation unit for instructing the mobile crane on operation; and a control unit that, when the operation mode is selected by the mode selection unit, assigns the operation corresponding to the selected operation mode to the operation unit, and transmits an operation signal from the operation unit, to the mobile crane.

An invention related to a remote operation system of a mobile crane according to the present invention includes: the remote operation terminal described above; a mobile crane including a boom; and an overload prevention device that is provided in at least one of the remote operation terminal and the mobile crane, has a plurality of limited movable ranges, and sets an operation range of the boom to a limited movable range corresponding to an operation mode selected in a mode selection unit of the remote operation terminal.

Effects of the Invention

According to the present invention, various works can be performed by remote operation while securing safety.

DESCRIPTION OF EMBODIMENTS

1. First Embodiment

Next, a first embodiment of the present invention will be described with reference to the drawings. A remote operation system A according to the first embodiment of the present invention is used for remotely operating a mobile crane C. Examples of the mobile crane C include an all-terrain crane, a rough terrain crane, a truck crane, a loading type truck crane, and the like.

1.1 Mobile Crane C

Figure 4:
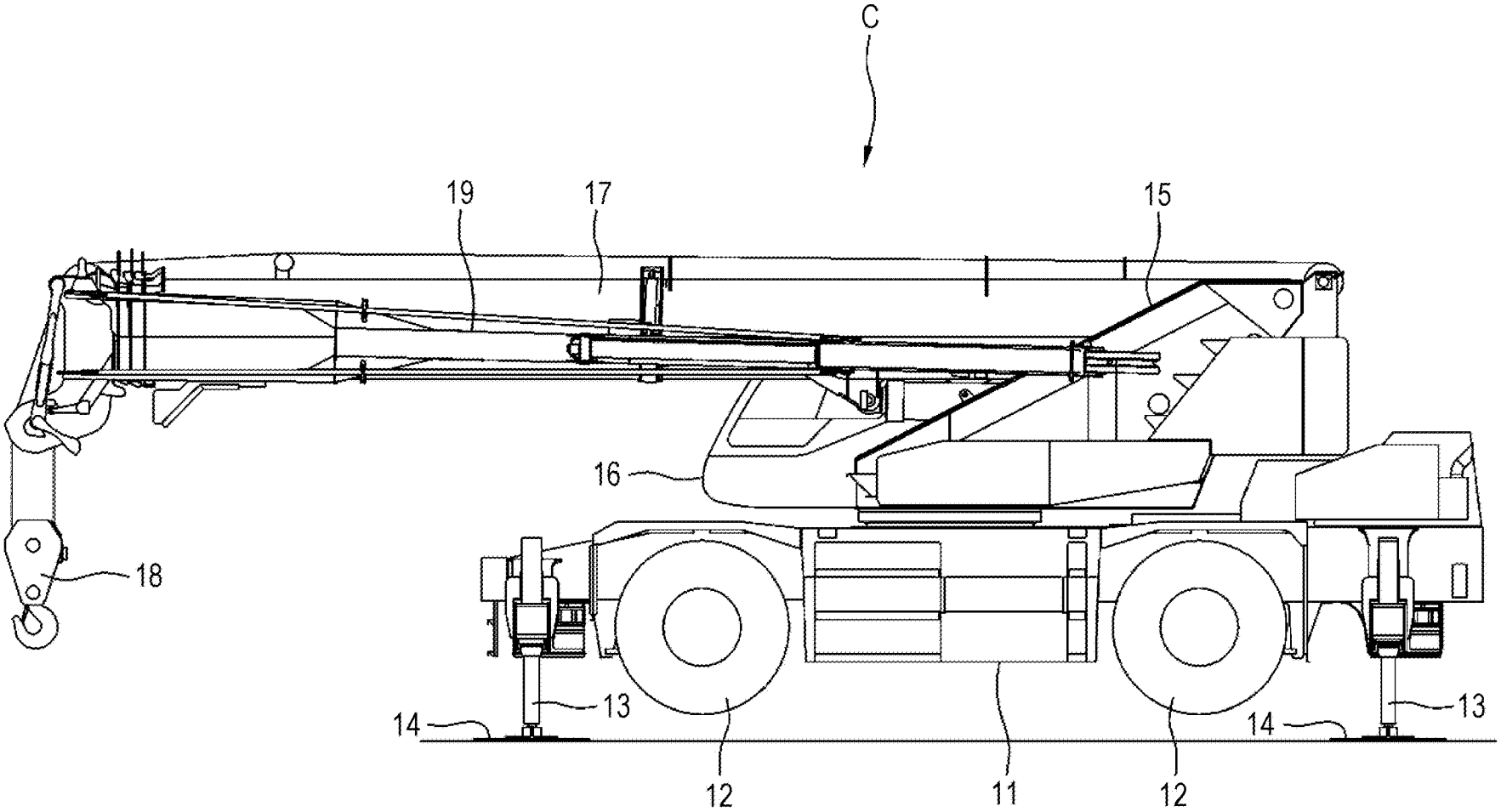
FIG. 4 is a side view of a mobile crane.

First, a basic structure of the mobile crane C will be explained. A traveling vehicle body 11 shown in FIG. 4 includes a tire 12 for running, an engine (not shown), and an outrigger 13. FIG. 4 shows the traveling vehicle body 11 in a state in which the outrigger 13 overhangs. The outrigger 13 jacks up with a float placed on a floor board 14 installed on the ground.

A turning base 15 is mounted on the traveling vehicle body 11. The turning base 15 can be turned by 360° in a horizontal plane by a turning motor. A cab 16 is provided on the turning base 15.

A boom 17 is attached to the turning base 15 so as to be freely raised and lowered. A base end portion of the boom 17 is pivotally supported by the turning base 15 with a pin. A derricking cylinder is attached between the boom 17 and the turning base 15. When this derricking cylinder is expanded or contracted, the boom 17 is raised or lowered.

The boom 17 is a multistage boom formed in a telescopic shape. The boom 17 is expanded and contracted by a telescopic cylinder. A wire rope provided with a hook 18 is suspended on a tip end portion of the boom 17. In a state shown in FIG. 4, the wire rope is guided by the turning base 15 along the boom 17 and wound around a winch.

The winch rotates forward and reverse by driving of a hoist motor. For example, when the winch rotates in one direction, the wire rope is wound up and the hook 18 ascends (that is, approaches the tip end portion of the boom 17). On the other hand, when the winch rotates in the other direction, the wire rope is sent out and the hook 18 descends (that is, separates from the tip end portion of the boom 17).

The raising, lowering, expansion, contraction, and swinging of the boom 17, and ascending and descending of the hook 18 are combined so that the mobile crane C can perform loading and unloading in a three-dimensional space.

The mobile crane C includes a jib 19. The jib 19 is used to obtain a lifting height and a working radius that are larger than a lifting height and a working radius with a boom length of the boom 17 fully expanded. When not in use (that is, in a state shown in FIG. 4), the jib 19 is stored along a side surface of the boom 17. At the time of use, a base end portion of the jib 19 and the tip end portion of the boom 17 are connected to each other, and the jib 19 overhangs in front of the boom 17.

1.2 Remote Operation System A

Figure 1:
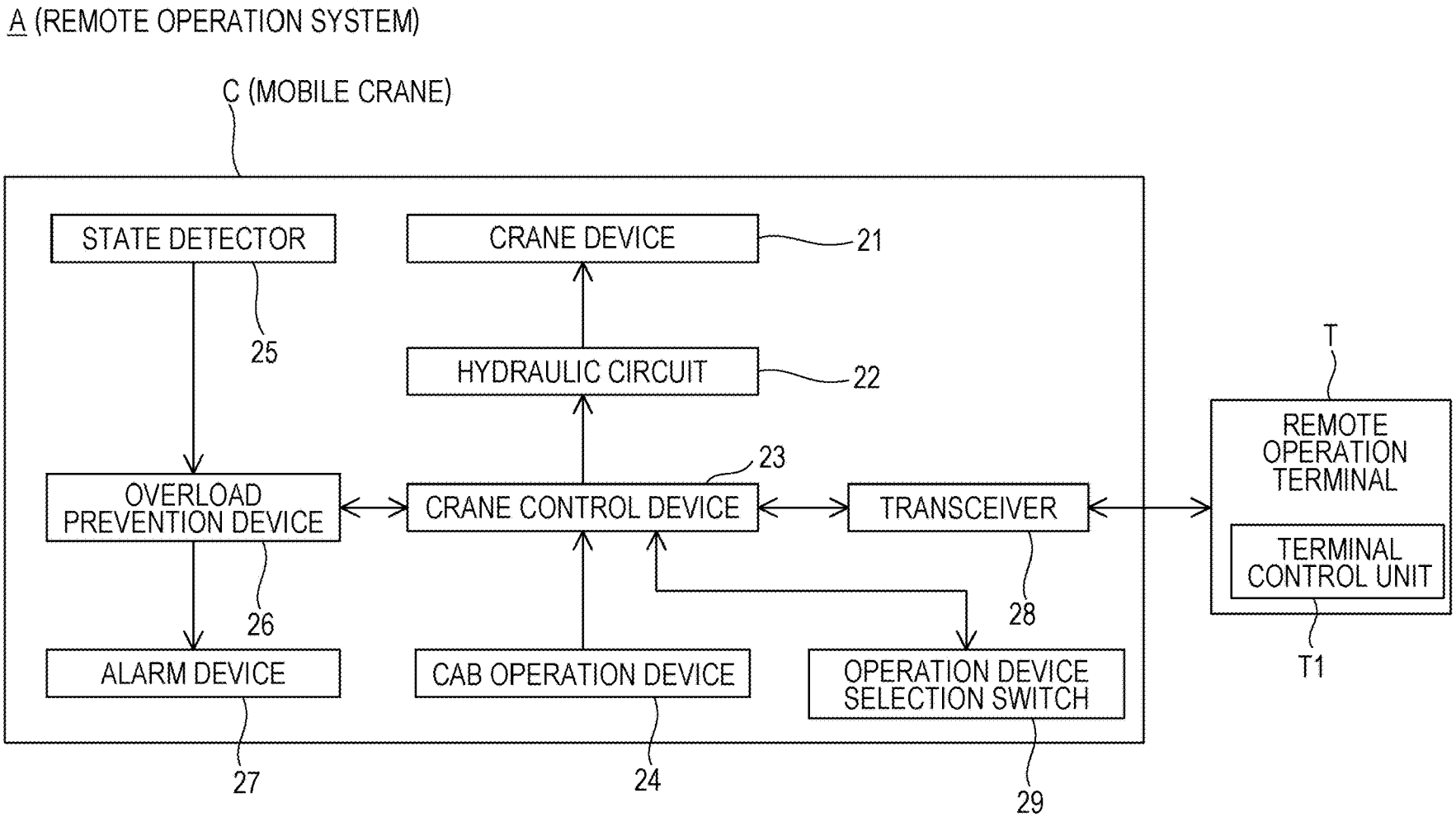
FIG. 1 is a block diagram of a remote operation system according to a first embodiment of the present invention.

Next, a configuration of the remote operation system A will be described. As shown in FIG. 1, the remote operation system A includes a remote operation terminal T. The remote operation system A includes, as components of the mobile crane C, a crane device 21, a hydraulic circuit 22, a crane control device 23, a cab operation device 24, a state detector 25, an overload prevention device 26, an alarm device 27, a transceiver 28, and an operation device selection switch 29.

The crane device 21 is various members used for a crane work such as the turning base 15, the boom 17, the hook 18, the jib 19, and the outrigger 13.

The crane device 21 is hydraulically driven by the hydraulic circuit 22. The hydraulic circuit 22 includes a hydraulic actuator, a hydraulic pressure source, a solenoid valve, and the like.

The hydraulic actuator is a turning motor that turns the turning base 15, a derricking cylinder that raises and lowers the boom 17, a telescopic cylinder that expands and contracts the boom 17, a hoist motor that drives the winch, and the like.

The hydraulic pressure source supplies hydraulic fluid to the hydraulic actuator.

The solenoid valve switches the flow rate and direction of the hydraulic fluid supplied to the hydraulic actuator.

The crane control device 23 controls the hydraulic circuit 22 to control the operation of the crane device 21. Specifically, the crane control device 23 switches the solenoid valve of the hydraulic circuit 22 to switch the flow rate and direction of the hydraulic fluid supplied to the hydraulic actuator. In this way, the crane control device 23 controls the operation of the crane device 21. The crane control device 23 is a computer composed of an input terminal, an output terminal, a CPU, a memory, and the like. The function of the crane control device 23 is realized by the CPU executing the program stored in a memory.

The cab operation device 24 is a control device such as a lever or a pedal provided in the cab 16. When the worker operates the cab operation device 24, an operation signal by the operation is transmitted to the crane control device 23. The crane control device 23 controls the operation of the crane device 21 based on the operation signal. Therefore, the worker can operate the mobile crane C (crane device 21) with the cab operation device 24 in the cab 16.

The state detector 25 is various detectors for detecting a posture, an actual moment, an actual load, and the like of the boom 17. Here, the actual moment corresponds to the one obtained by multiplying the actual load by the working radius. An example of the state detector 25 is a posture detector for detecting the posture of the boom 17. Specifically, examples of the posture detector include a length detector for detecting a length of the boom 17, a derrick angle detector for detecting a derrick angle of the boom 17, or a turning angle detector for detecting the turning angle of the boom 17.

A detection value of the state detector 25 is input to the overload prevention device 26. The overload prevention device 26 is a computer composed of an input terminal, an output terminal, a CPU, a memory, and the like. The function of the overload prevention device 26 is realized by the CPU executing the program stored in the memory.

The overload prevention device 26 has a function of limiting the operation of the boom 17 on the basis of the detection value of the state detector 25 so that the actual moment does not exceed a rated moment. Specifically, the rated moment in various postures of the boom 17 is stored in the overload prevention device 26 in advance.

The overload prevention device 26 obtains the rated moment in the current posture of the boom 17. Then, the overload prevention device 26 obtains the load factor (=actual moment/rated moment) from the obtained rated moment and actual moment.

When the load factor reaches 90% or more, the alarm device 27 issues an alarm. When the load factor is 100% or more, the overload prevention device 26 transmits a stop signal to the crane control device 23 to stop the operation to a dangerous side such as expansion and lodging of the boom 17. As described above, the actual moment corresponds to the one obtained by multiplying the actual load by the working radius. Therefore, the operation to the dangerous side is, for example, an operation in which the actual moment is increased (that is, the working radius is increased).

In the control described above, an actual load may be used instead of the actual moment and a rated total load may be used instead of the rated moment. That is, the operation of the boom 17 is limited so that the actual load does not exceed the rated total load. Here, the rated moment corresponds to the one obtained by multiplying the rated total load by the working radius.

The overload prevention device 26 stores a plurality of patterns of limited movable ranges. The overload prevention device 26 also has a function of limiting the operation of the boom 17 to one selected limited movable range. Here, the limited movable range is a range predetermined as a movable range (in other words, an operation range) of the boom 17. As will be described later, the limited movable range is applied when the mobile crane C is remotely operated. Generally, the risk of the operation is higher in the case of the remote operation than in the case where the mobile crane C is operated in the cab 16. Therefore, in the case of the remote operation, safety is ensured by limiting the operation of the boom 17 to the limited movable range.

Specifically, the overload prevention device 26 determines the relationship between the posture of the boom 17 and the limited movable range based on the detection value of the state detector 25. The overload prevention device 26 limits the operation of the boom 17 to the limited movable range according to the result of the determination. When the posture of the boom 17 approaches the limited movable range, the alarm device 27 issues an alarm. When the posture of the boom 17 exceeds the limited movable range, the overload prevention device 26 transmits a stop signal to the crane control device 23. Upon receiving the stop signal, the crane control device 23 stops the operation to the dangerous side such as a side with elongation and lodging of the boom 17.

In the present embodiment, two limited movable ranges of the on-tire limited movable range and the jack-up limited movable range are stored in the overload prevention device 26. The on-tire limited movable range is applied when the working state of the mobile crane C is an on-tire state where the tire 12 is grounded (in other words, a state where the outrigger 13 is not jacked up). On the other hand, when the working state of the mobile crane C is in the jack-up state in which the mobile crane C is jacked up by the outrigger 13, the jack-up limited movable range is applied.

In the on-tire state, the stability of the mobile crane C against falling is relatively lower than the stability in the jack-up state. Therefore, the on-tire limited movable range is set to an operation range that is relatively smaller than the jack-up limited movable range. For example, the on-tire limited movable range is set such that the maximum value of a rated total load is 0.5t and the maximum length of a boom length is fully reduced+1 m.

On the other hand, in the jack-up state, the stability of the mobile crane C against falling is relatively higher than the stability in the on-tire state. The jack-up limited movable range can be set to an operation range relatively larger than the on-tire limited movable range according to the overhanging width of the outrigger 13. That is, in the on-tire operation mode, an operation unit (a lever switch 35 described later) of the remote operation terminal T may instruct the mobile crane C on the operation, within a smaller operation range than the jack-up operation mode.

As described above, in the present embodiment, the limited movable range is set for each working state (the on-tire state or the jack-up state) of the mobile crane C. Which limited movable range among a plurality of limited movable ranges the overload prevention device 26 uses to control the operation of the boom 17 will be described in detail later.

The transceiver 28 has a function of transmitting and receiving data to and from the remote operation terminal T wirelessly or by wire. Upon receiving the data transmitted by the crane control device 23, the transceiver 28 converts the received data (that is, the transmission data of the crane control device 23) into a signal for communication and transmits the signal to the remote operation terminal T. Upon receiving the data transmitted from the remote operation terminal T, the transceiver 28 converts the received data into a format usable by the crane control device 23 and transmits the converted data to the crane control device 23.

The remote operation terminal T (specifically, a terminal control unit T1 described later) can bidirectionally communicate with the crane control device 23 via the transceiver 28. The remote operation terminal T can bidirectionally communicate with the overload prevention device 26 via the transceiver 28 and the crane control device 23. It should be noted that the present invention may be configured so that the remote operation terminal T and the overload prevention device 26 are bidirectionally communicable with each other not via the crane control device 23.

The remote operation terminal T includes a wireless operation terminal including a so-called radio control transmitter and a wired operation terminal. When the worker operates the remote operation terminal T, an operation signal by the operation is transmitted to the crane control device 23 via the transceiver 28.

Specifically, when the worker operates the remote operation terminal T, the terminal control unit T1 of the remote operation terminal T transmits the operation signal related to the operation described above to the transceiver 28. When the transceiver 28 receives the operation signal, the transceiver 28 converts the operation signal into a format usable by the crane control device 23 and transmits the converted signal to the crane control device 23. The crane control device 23 controls the operation of the crane device 21 based on the operation signal. Therefore, the worker can remotely operates the mobile crane C (the crane device 21) using the remote operation terminal T.

The operation device selection switch 29 is a switch for selecting any one of the remote operation terminal T and the cab operation device 24 as the operation device of the mobile crane C. The operation device selection switch 29 is provided in the cab 16. The operation device selection switch 29 transmits a signal relating to the selection result to the crane control device 23.

When the crane control device 23 receives the signal relating to the result of the selection, the crane control device 23 accepts only the operation signal from the operation device (that is, the remote operation terminal T or the cab operation device 24) selected by the operation device selection switch 29. Then, the crane control device 23 controls the operation of the crane device 21 based on the operation signal.

With such a configuration, the worker cannot operate the crane device 21 by using the remote operation terminal T and the cab operation device 24 together. Therefore, the crane device 21 does not perform an unintended operation and it is safe.

It should be noted that when the remote operation terminal T is selected by the operation device selection switch 29, the power supply of the transceiver 28 may be turned on, and when the cab operation device 24 is selected by the operation device selection switch 29, the power supply of the transceiver 28 may be turned off.

The operation device selection switch 29 corresponds to an operation device selection means. The operation device selection means may have a function of selecting any one of the remote operation terminal T and the cab operation device 24. For example, a power button of the remote operation terminal T may be used as the operation device selection means. In this case, when the power supply of the remote operation terminal T is ON, the crane control device 23 accepts only the operation signal from the remote operation terminal T. On the other hand, when the power supply of the remote operation terminal T is OFF, the crane control device 23 accepts only the operation signal from the cab operation device 24.

1.3 Remote Operation Terminal T

The outline of the remote operation terminal T will be described below. The remote operation terminal T is a remote operation terminal for remotely operating the mobile crane C, and includes: a mode selection unit (for example, a pushbutton switch 34 described later) for selecting an operation mode corresponding to work of the mobile crane C from a plurality of operation modes (for example, an outrigger mode, a jib-set mode, and a crane mode described later); an operation unit (for example, a lever switch 35 described later) for instructing the mobile crane C on operation; and a control unit (for example, the terminal control unit T1 described later) that, when the operation mode is selected by the mode selection unit, assigns the operation corresponding to the selected operation mode to the operation unit, and transmits an operation signal from the operation unit, to the mobile crane C.

Figure 2B:
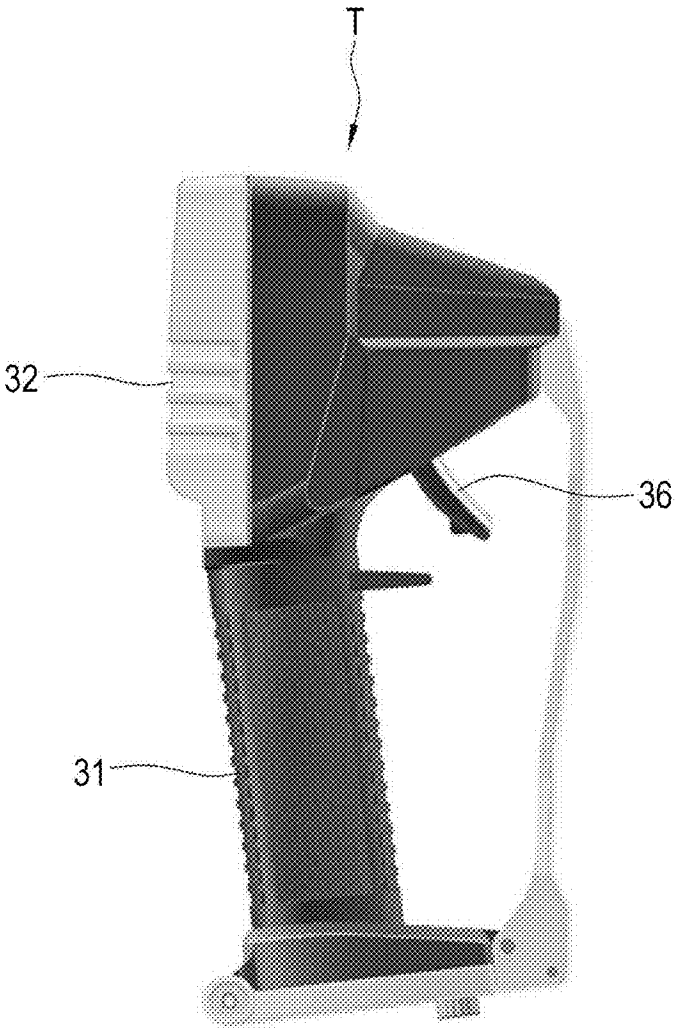
FIG. 2B is a side view of the remote operation terminal.
Figure 2A:
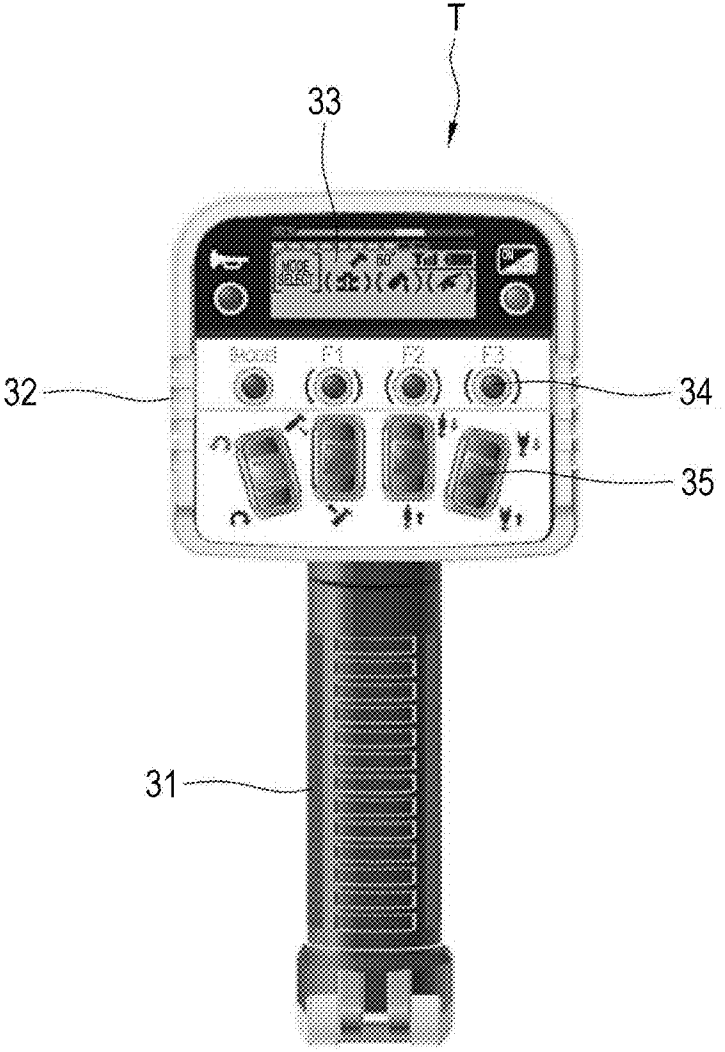
FIG. 2A is a front view of a remote operation terminal.

Next, a specific structure of the remote operation terminal T will be described. As shown in FIG. 2A and FIG. 2B, the remote operation terminal T includes a handle 31, a head portion 32, a liquid crystal panel 33, a pushbutton switch 34 that is an example of the mode selection unit, a lever switch 35 that is an example of the operation unit, a trigger switch 36, and the terminal control unit T1 (see FIG. 1) that is an example of the control unit.

The liquid crystal panel 33 is a display unit and is arranged on a front face of the head portion 32.

The pushbutton switch 34 is an input unit and is arranged on the front face of the head portion 32. Specifically, the worker can select one operation mode from a plurality of operation modes included in the remote operation terminal T, by the pushbutton switch 34.

The lever switch 35 is an input unit and is arranged on the front face of the head portion 32. The worker operates the lever switch 35 to instruct the mobile crane C on the operation.

The trigger switch 36 is an input unit and is arranged behind the handle 31. The worker can switch whether the mobile crane C is operated by the lever switch 35 by operating the trigger switch 36.

It should be noted that the lever switch 35 serving as the operation unit may instruct the mobile crane C on the operation, within the operation range smaller than the operation range of the mobile crane C that can be instructed from the cab operation device 24 of the mobile crane C.

When the operation mode is selected by the pushbutton switch 34, the terminal control unit T1 assigns the operation corresponding to the selected operation mode, to the lever switch 35. As a result, operation of the lever switch 35 enables operation corresponding to the selected operation mode. The terminal control unit T1 transmits an operation signal from the lever switch 35 to the mobile crane C. Such terminal control unit T1 can be composed by, for example, a computer composed of an input terminal, an output terminal, a CPU, a memory, and the like. The terminal control unit T1 may assign only the operation corresponding to the selected operation mode to the lever switch 35.

When the worker operates the input units 34, 35, 36 of the remote operation terminal T, the remote operation terminal T (specifically, the terminal control unit T1 of the remote operation terminal T) transmits an operation signal to the crane control device 23. The crane control device 23 controls the operation of the crane device 21 based on the operation signal. The actual load, the rated total load, the load factor, or the like transmitted from the overload prevention device 26 are displayed on the display unit 33 of the remote operation terminal T.

While the mobile crane C can perform various operations, the number of the input units 34, 35, 36 of the remote operation terminal T is limited. Therefore, the remote operation terminal T has a plurality of operation modes. The remote operation terminal T facilitates the operation by switching the functions of the input units 34, 35, 36 in each operation mode. In other words, when the operation mode is selected by the input unit 34, the operation corresponding to the selected operation mode is assigned to the input units 35, 36, in the remote operation terminal T.

Figure 3:
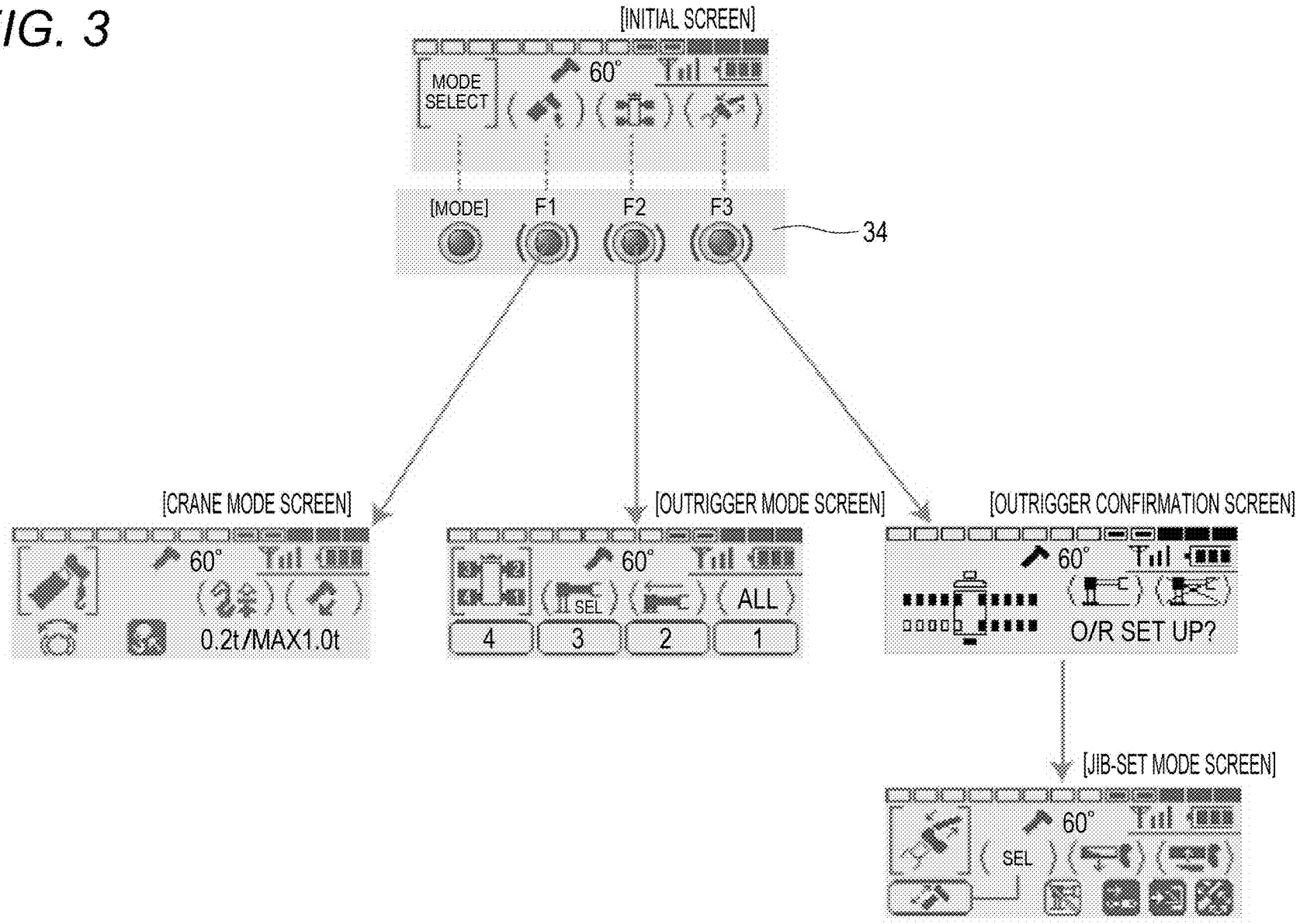
FIG. 3 is a screen transition diagram of a screen displayed on a display unit of the remote operation terminal.

FIG. 3 shows a screen transition diagram of a screen displayed on the display unit 33 of the remote operation terminal T. When the remote operation terminal T is in the initial mode, an initial screen is displayed on the display unit 33. When the specific pushbutton switch 34 (that is, a pushbutton switch F1 corresponding to a crane mode) is pushed in the initial mode, the remote operation terminal T enters the crane mode and the crane mode screen is displayed on the display unit 33. In the crane mode, by operating the lever switch 35 and the trigger switch 36, the operation (raising, lowering, expansion, contraction, and turning of the boom 17, and ascending and descending of the hook 18) of the crane device 21 required for suspended loading work (that is, suspended loading work for preparation or tidying work) can be performed.

In other words, in the crane mode, the type of operation that can be performed by the lever switch 35 of the remote operation terminal T is limited to the operation (raising, lowering, expansion, contraction, and turning of the boom 17, and ascending and descending of the hook 18) of the crane device 21 required for suspended loading work performed in the preparation or tidying work such as installation or tidying of the floor board 14 described later. Therefore, in the crane mode, the number of types of operation that can be performed by the remote operation terminal T is smaller than the number of types of operation that can be performed by the cab operation device 24. The present invention may be configured so that, in the crane mode, instruction of operations other than the operation of the crane device 21 necessary for the suspended loading work described above may be performed from the remote operation terminal T.

When the other pushbutton switch 34 (that is, the pushbutton switch F2 corresponding to the outrigger mode) is pushed in the initial mode, the remote operation terminal T enters the outrigger mode and the outrigger mode screen is displayed on the display unit 33. In the outrigger mode, the outrigger 13 can overhang and be stored by the operation of the lever switch 35 and the trigger switch 36. The raising, lowering, expansion, contraction, and turning of the boom 17, and the ascending and descending of the hook 18 cannot be performed.

In other words, in the outrigger mode, the type of operation that can be performed by the lever switch 35 of the remote operation terminal T is limited to the operation (overhanging and storage of the outrigger 13) of the crane device 21 required for the overhanging and storage work of the outrigger 13. Therefore, also in the outrigger mode, the number of types of operation that can be performed by the remote operation terminal T is smaller than the number of types of operation that can be performed by the cab operation device 24. The present invention may be configured so that, in the outrigger mode, instruction of operations other than the operation of the crane device 21 required for the overhanging and storage work of the outrigger 13 can be performed from the remote operation terminal T.

When another pushbutton switch 34(F3) is pushed in the initial mode, an outrigger confirmation screen is displayed on the display unit 33. On the outrigger confirmation screen, the overhanging width of the outrigger 13 and the like are displayed. When the worker pushes the pushbutton switch 34 corresponding to YES (that is, the pushbutton switch F2 corresponding to the jib-set mode) after confirming the overhanging width of the outrigger 13 on the outrigger confirmation screen, the remote operation terminal T enters the jib-set mode, and the jib-set mode screen is displayed on the display unit 33.

In the jib-set mode, the operation (raising, lowering, expansion, contraction, and turning of the boom 17, and the overhanging, storage, raising, and lowering of the jib 19) of the crane device 21 required for overhanging and storage of the jib can be performed by the operation of the lever switch 35 and the trigger switch 36.

In other words, in the jib-set mode, the type of operation that can be performed by the remote operation terminal T is limited to the operation (raising, lowering, expansion, contraction, and turning of the boom 17, and the overhanging, storage, raising, and lowering of the jib 19) of the crane device 21 required for overhanging and storage of the jib. Therefore, in the jib-set mode, the number of types of operation that can be performed by the remote operation terminal T is smaller than the number of types of operation that can be performed by the cab operation device 24. The present invention may be configured so that, in the jib-set mode, instruction of operations other than the operation of the crane device 21 required for overhanging and storage of the jib can be performed by the remote operation terminal T.

The crane mode is used for installation and tidying of the floor board 14 in preparation work or tidying work of the mobile crane C. In the installation work of the floor board 14, the floor board 14 is suspended with the hook 18, moved to the installation position of the outrigger 13, and set on the ground. On the other hand, in the tidying work of the floor board 14, the floor board 14 installed on the ground is suspended by the hook 18 and moved to the storage position of the floor board 14. In any case, in installation work and tidying work of the floor board 14, the mobile crane C is in the on-tire state where the tire 12 is grounded.

The outrigger mode is used for overhanging or storage of the outrigger 13, which is the preparation work or the tidying work of the mobile crane C. At this time, the mobile crane C may be in the on-tire state.

The jib-set mode is used for overhanging or storage of the jib 19, which is the preparation work or the tidying work of the mobile crane C. At this time, the mobile crane C is in the jack-up state.

As described above, the operation mode of the remote operation terminal T and the working state (the on-tire state or the jack-up state) of the mobile crane C are in a corresponding relationship. In other words, the crane mode and the outrigger mode (only in the case of the on-tire state) corresponding to the on-tire state of the mobile crane C can also be called the on-tire operation mode. On the other hand, the jib-set mode corresponding to the jack-up state of the mobile crane C can also be called the jack-up operation mode.

Regarding the on-tire operation mode described above, the type of operation that can be performed by the lever switch 35 of the remote operation terminal T may be limited to the operation of the crane device 21 required for the operation performed in the on-tire state of the mobile crane C. On the other hand, also regarding the jack-up operation mode, the type of operation that can be performed by the lever switch 35 of the remote operation terminal T may be limited to the operation of the crane device 21 required for the work to be performed in the jack-up state of the mobile crane C. Accordingly, in the on-tire operation mode and the jack-up operation mode, the number of types of operation that can be performed by the remote operation terminal T may be smaller than the number of types of operation that can be performed by the cab operation device 24.

The on-tire operation mode may include operation modes including the crane mode or the outrigger mode described above and corresponding to various operations performed in the on-tire state. On the other hand, the jack-up operation mode may include not only the jib-set mode described above but also operation modes corresponding to various operations performed in the jack-up state.

As described above, the limited movable range (the on-tire limited movable range, or the jack-up limited movable range) for each working state is set in the overload prevention device 26. That is, the operation mode of the remote operation terminal T and the limited movable range are in a correspondence relationship. Specifically, the crane mode corresponds to the on-tire state of the mobile crane C and the on-tire limited movable range. The jib-set mode corresponds to the jack-up state of the mobile crane C and the jack-up limited movable range.

A correspondence relationship between the operation mode and the limited movable range is stored in the remote operation terminal T (for example, a storage unit such as a memory not shown). Specifically, the remote operation terminal T stores that the crane mode (that is, the on-tire operation mode) corresponds to the on-tire limited movable range, and the jib-set mode (that is, the jack-up operation mode) corresponds to the jack-up limited movable range.

The remote operation terminal T selects the limited movable range corresponding to the operation mode after switching, in the switching operation of the operation mode as described above. Then, the remote operation terminal T transmits the selection signal that is the result of the selection described above, to the overload prevention device 26. In this manner, the remote operation terminal T is configured to select the limited movable range corresponding to the operation mode after switching among of the plurality of limited movable ranges, by the switching operation of the operation mode.

The overload prevention device 26 that has received the selection signal described above limits the operation of the boom 17 to one limited movable range corresponding to the selection signal among the plurality of limited movable ranges, based on the selection signal. It should be noted that the remote operation terminal T (specifically, the terminal control unit T1) may transmit a selection signal indicating the operation mode after switching to the overload prevention device 26, at the time of the switching operation of the operation mode.

Then, the overload prevention device 26 selects the limited movable range corresponding to a selection signal (that is, the operation mode of the remote operation terminal T) indicating the operation mode from among a plurality of limited movable ranges, based on the received selection signal indicating the operation mode described above. When such a configuration is adopted, the overload prevention device 26 selects the limited movable range based on the correspondence relationship between the operation mode of the remote operation terminal T and the limited movable range stored in the overload prevention device 26.

1.4 Operation of Remote Operation System A

Next, the operation of the remote operation system A will be described together with the work flow of the mobile crane C. The works and operations of the mobile crane C are performed in the order (1) to (5) below.

(1) Travel and move to a work site (2) Perform the preparation work at the work site (3) Perform the suspended loading work (4) Perform the tidying work after completion of the suspended loading work (5) Travels and moves from the work site after the tidying work <1.4.1 Preparation Work of (2)>

The preparation work of (2) described above is mainly performed in the order of (2-1) to (2-3) below.

(2-1) Install the floor board 14

(2-2) Overhang the outrigger 13

(2-3) Overhang the jib 19

The preparation work of (2-1) to (2-3) described above will be described below in order.

First, the worker selects the remote operation terminal T by operating the operation device selection switch 29. As a result, the worker can remotely operate the mobile crane C using the remote operation terminal T.

<1.4.2 Installation of the Floor Board of (2-1)>

First, the worker pushes a specific pushbutton switch 34(F1) of the remote operation terminal T to switch the remote operation terminal T to the crane mode. Then, the remote operation terminal T selects the on-tire limited movable range corresponding to the crane mode. Then, the remote operation terminal T (specifically, the terminal control unit T1) transmits the selection result of the on-tire limited movable range to the overload prevention device 26, as a selection signal. As a result, the on-tire limited movable range is selected from the plurality of limited movable ranges of the overload prevention device 26.

The worker operates the lever switch 35 and the trigger switch 36 of the remote operation terminal T to operate the crane device 21 and install the floor board 14 at the installation position of the outrigger 13. At this time, the overload prevention device 26 limits the operation of the boom 17 to the on-tire limited movable range.

In other words, in the crane mode, the remote operation terminal T is limited so that only raising, lowering, expansion, contraction, and turning of the boom 17, or ascending and descending of the hook 18 required for the installation of the floor board 14, can be operated. In addition, in the crane mode, the operation range of the boom 17 in which the remote operation terminal T can operate (in other words, instruct) is limited to the on-tire limited movable range. In the crane mode, the operation of which instruction can be performed from the remote operation terminal T and the operation range of the mobile crane C corresponding to the crane mode is referred to as the operation performance in the crane mode.

<1.4.3 (2-2) Outrigger Overhanging>

Next, the worker pushes a specific pushbutton switch 34(F2) of the remote operation terminal T to switch the remote operation terminal T to the outrigger mode. The worker operates the lever switch 35 and the trigger switch 36 of the remote operation terminal T to operate the outrigger 13 and make the outrigger 13 overhang.

That is, in the outrigger mode, the remote operation terminal T can perform only operations that are set (that is, assigned) in advance corresponding to the outrigger mode. In the outrigger mode, the operation of which instruction can be performed from the remote operation terminal T and the operation range of the mobile crane C corresponding to the outrigger mode are referred to as the operation performance in the outrigger mode.

As described above, in the outrigger mode, the raising, lowering, expansion, contraction, and turning of the boom 17, or the ascending and descending of the hook 18 cannot be performed by the operation of the remote operation terminal T. That is, in the outrigger mode, the limited movable range may be set so that the raising, lowering, expansion, contraction, and turning of the boom 17, or the ascending and descending of the hook 18 cannot be performed.

<1.4.4 (2-3) Jib Overhanging>

Next, the worker pushes a specific pushbutton switch 34(F3) of the remote operation terminal T. Then, the outrigger confirmation screen is displayed on the display unit 33. When the pushbutton switch 34(F2) corresponding to YES is pushed in this state, the remote operation terminal T is switched to the jib-set mode. At this time, the remote operation terminal T selects the jack-up limited movable range corresponding to the jib-set mode. Then, the remote operation terminal T (specifically, the terminal control unit T1) transmits the result of selecting of the jack-up limited movable range, as a selection signal, to the overload prevention device 26. As a result, the jack-up limited movable range is selected from the plurality of limited movable ranges of the overload prevention device 26.

The worker operates the lever switch 35 and the trigger switch 36 of the remote operation terminal T to operate the crane device 21 and make the jib 19 overhang. At this time, the overload prevention device 26 limits the operation of the boom 17 to the jack-up limited movable range.

In other words, in the jib-set mode for performing the jib overhanging operation, the remote operation terminal T is limited so as to be able to operate only the raising, lowering, expansion, contraction, and turning of the boom 17, or the overhanging, storage, or raising and lowering of the jib 19 required for the jib overhanging operation.

In the jib-set mode, the operation range of the boom 17 in which operation (in other words, instruction) can be performed from the remote operation terminal T is limited to the jack-up limited movable range. In the jib-set mode, the operation of which instruction can be performed from the remote operation terminal T and the operation range of the mobile crane C corresponding to the jib-set mode are referred to as the operation performance in the jib-set mode.

As described above, in the case of the present embodiment, the operation performance of the mobile crane C (crane device 21) is limited according to each mode.

In the remote operation system A as described above, since the limited movable range can be selected by the operation of the remote operation terminal T, the limited movable range can be switched according to the working state of the mobile crane C. As a result, various operations can be performed by remote operation while securing safety. The worker can operate the crane device 21 while performing the rigging work and the operation around the jib 19 outside the cab 16. Therefore, it is unnecessary for the worker to go back and forth between the inside and the outside of the cab 16, and the work efficiency is preferable.

In addition, the limited movable range is automatically switched by switching the operation mode of the remote operation terminal T. Therefore, it is unnecessary for a worker to intentionally switch the limited movable range, thereby facilitating the work.

<1.4.5 Suspended Loading Work of (3)>

In order to perform the suspended loading work of (3) described above (that is, the normal suspended loading work), the worker first operates the operation device selection switch 29 to select the cab operation device 24. Then, the crane device 21 can be operated using the cab operation device 24. The suspended loading work is the usual work of the mobile crane C. When performing the suspended loading work, the worker cannot operate the crane device 21 with the remote operation terminal T.

The worker operates the cab operation device 24 in the cab 16 to perform the suspended loading work. At this time, the overload prevention device 26 limits the operation of the boom 17 so that the actual moment does not exceed the rated moment. Otherwise, the overload prevention device 26 limits the operation of the boom 17 so that the actual load does not exceed the rated total load. As described above, when the remote operation terminal T is selected as the operation device, the overload prevention device 26 limits the operation of the boom 17 to the limited movable range. On the other hand, when the cab operation device 24 is selected as the operation device, the overload prevention device 26 allows the operation (that is, the operation range) of the boom 17 within a range where the stability of the mobile crane C can be secured.

Therefore, when the mobile crane C is operated by the remote operation terminal T, since the operation (that is, the operation range) of the boom 17 is limited to the limited movable range, it is safe. When the mobile crane C is operated with the cab operation device 24, the operation of the boom 17 is allowed within the range where the stability of the mobile crane C can be secured, so that efficient work can be performed. That is, the operation range of the mobile crane C in which the instruction can be performed by the remote operation terminal T (specifically, the lever switch 35) is smaller than the operation range of the mobile crane C that can be instructed from the cab operation device 24.

<1.4.6 Tidying Work of (4)>

The tidying work of (4) described above is performed, for example, in the following order of (4-1) to (4-3).

(4-1) Store the jib 19

(4-2) Store the outrigger 13

(4-3) Tidy the floor board 14

In other words, the tidying work can be performed in the reverse order of the preparation work.

1.5 Other Embodiments

Selection of the limited movable range by the remote operation terminal T may be realized with the following configuration.

The correspondence relationship between the operation mode of the remote operation terminal T and the limited movable range is stored in the overload prevention device 26. At the time of switching of the operation mode, the remote operation terminal T transmits a selection signal indicating the operation mode after switching, to the overload prevention device 26. The overload prevention device 26 that has received the selection signal selects a limited movable range corresponding to the selection signal (in other words, the operation mode after switching) from the plurality of limited movable ranges based on the selection signal.

As described above, the remote operation terminal T may select the limited movable range and transmit the selection signal to the overload prevention device 26, or select the operation mode and transmit the selection signal to the overload prevention device 26. In any case, the remote operation terminal T is configured to be able to directly or indirectly perform the remote operation related to the selection of the limited movable range.

When the crane device 21 is remotely operated using the remote operation terminal T, the operation speed of the crane device 21 may be made slower than usual. For example, the operation speed of the crane device 21 may be set to 50% of the usual speed. Here, usual means the operating speed in the case of operating the crane device 21 using the cab operation device 24 (that is, usual work).

The operation mode of the remote operation terminal T is not limited to three of the crane mode, the outrigger mode, and the jib-set mode. Other operation modes of the remote operation terminal T include a counterweight mode, a usual work mode, a single top mode, and a maintenance mode. The counterweight mode is used for attaching and detaching of a counterweight.

The usual work mode is used for the suspended loading work of (3) described above. The single top mode is used for the suspended loading work with wire rope with one hook. The maintenance mode is, for example, a mode for applying grease to the boom 17, and the stage of the boom 17 can be extended by one by one.

The limited movable range may be set corresponding to each of the operation modes described above. That is, the limited movable range is not limited to two of the on-tire limited movable range and the jack-up limited movable range. For example, a relatively wide limited movable range corresponding to the overhanging width of the outrigger 13 may be set so that the suspended loading work that is free to some extent can be performed in the usual work mode.

Needless to say, examples of the limited movable range in the usual work mode include a range in which the actual moment does not exceed the rated moment, or a range in which the actual load does not exceed the rated total load, in the operation of the boom 17.

As similar to the crane mode, outrigger mode, and jib-set mode described above, the remote operation terminal T is configured to be able to perform the operations that are set (that is, assigned to the operation unit) in advance corresponding to the other operation modes described above, also in the other operation modes described above. The remote operation terminal T is configured so that the operation range of the boom 17 is limited to the limited movable range corresponding to the other operation modes described above.

It is sufficient that the remote operation terminal T is configured to select one of the plurality of limited movable ranges by the operation of the remote operation terminal T. That is, the operation of the remote operation terminal T is not limited to the switching operation of the operation modes. For example, the remote operation terminal T may include a selection means such as a switch for directly selecting the limited movable range. In this case, the present invention may be configured so that one of the plurality of limited movable ranges may be selected by the selection operation of the limited movable range by the selection means.

In this case, since the worker can intentionally switch the limited movable range, which limited movable range is selected can be easily recognized.

1.6 Appendix

In the first embodiment described above, the overload prevention device 26 is provided in the mobile crane C. However, the overload prevention device 26 can be not provided. When the overload prevention device 26 is provided, the overload prevention device 26 can be provided in at least one of the mobile crane C and the remote operation terminal T. Therefore, the overload prevention device 26 can be provided in the remote operation terminal T without being provided in the mobile crane C. Furthermore, the overload prevention device 26 can be provided in both the mobile crane C and the remote operation terminal T.

In the first embodiment described above, the type of operation that can be instructed from the operation unit (specifically, the pushbutton switch 34) of the remote operation terminal T is limited to the operation corresponding to the operation mode selected by the mode selection unit. However, an instruction of operation other than the operation corresponding to the selected operation mode may be performed from the operation unit. In this case, it is preferable that the operation other than the operation corresponding to the selected operation mode is an operation that does not increase the risk of work.

Further, in the first embodiment, the pushbutton switch 34 that is the mode selection unit may be a dedicated input unit dedicated to the operation mode, or may be a dual purpose input unit shared with other operations. That is, in the case of the dual purpose input unit, functions for other operations may be assigned to the mode selection unit (the pushbutton switch 34 in the case of the present embodiment) together with a mode selection function for selecting the operation mode. In this case, it is preferable that the function exercised by the mode selection unit can be switched between the mode selection function and the functions for other operations.

In the first embodiment described above, a button or a lever is adopted as the pushbutton switch 34 that is an example of the mode selection unit and the lever switch 35 that is an example of the operation unit. However, the operation unit may be, for example, a rotary type or a slide type input unit. Further, the mode selection unit or the operation unit may be configured by, for example, icons displayed on a display unit such as a touch panel.

As a reference example 1 of a remote operation system of a mobile crane, for example, a remote operation system of a mobile crane having a boom, includes: a remote operation terminal for remotely operating a mobile crane; and an overload prevention device having a function of limiting operation of the boom so that an actual moment or an actual load does not exceed a rated moment or a rated total load, and a function of limiting the operation of the boom to one limited movable range selected from a plurality of limited movable ranges. The remote operation terminal can be configured to select one of the plurality of limited movable ranges by the operation of the remote operation terminal.

According to such reference example 1, the limited movable range can be switched by the operation of the remote operation terminal.

Therefore, various operations can be performed by remote operation while ensuring safety.

As a remote operation system of a mobile crane of a reference example 2, in the reference example 1, the remote operation terminal may be configured to have a plurality of operation modes, and select the limited movable range corresponding to the operation mode after switching from the plurality of limited movable ranges by switching operation of the operation mode.

According to the reference example 2, since the limited movable range is automatically switched by switching of the operation mode of the remote operation terminal, the worker does not need to intentionally switch the limited movable range, which facilitates the work.

As a remote operation system of a mobile crane of a reference example 3, in the reference example 1, the remote operation terminal may be configured to select one from the plurality of limited movable ranges by selection operation of the limited movable range.

According to the reference example 3, since the worker can intentionally switch the limited movable range, which limited movable range is selected can be easily recognized.

As a remote operation system of a mobile crane of a reference example 4, in the reference example 1, the reference example 2, or the reference example 3, the remote operation system may include a cab operation device included in a cab of the mobile crane, for operating the mobile crane described above, and an operation device selection means that selects any one of the remote operation terminal and the cab operation device as the operation device of the mobile crane.

According to the reference example 4, since the worker cannot operate the mobile crane by using the remote operation terminal and the cab operation device together, it is safe.

As a remote operation system of a mobile crane of a reference example 5, in the reference example 4, the overload prevention device may limit the operation of the operation of the boom to the limited movable range, when the remote operation terminal is selected as the operation device of the mobile crane, and limit the operation of the boom so that the actual moment or the actual load does not exceed the rated moment or the rated total load, when the cab operation device is selected as the operation device of the mobile crane.

According to the reference example 5, when the mobile crane is operated by the remote operation terminal, since the operation of the boom is limited to the limited movable range, it is safe. When the mobile crane is operated by the cab operation device, the operation of the boom is allowed within the range where the stability of the mobile crane can be secured, so that efficient work can be performed.

REFERENCE SIGNS LIST

A Remote operation system
C Mobile crane
T Remote operation terminal
21 Crane device
22 Hydraulic circuit
23 Crane control device
24 Cab operation device
25 State detector
26 Overload prevention device
27 Alarm device
28 Transceiver
29 Operation device selection switch

The invention claimed is:

1. A remote operation terminal for remotely operating a mobile crane, comprising:

a mode selection unit that can select an operation mode corresponding to work of the mobile crane from a plurality of operation modes;

an operation unit for instructing the mobile crane on operation; and a control unit that, when the operation mode is selected by the mode selection unit, transmits a signal indicating the operation mode selected by the mode selection unit to the mobile crane, assigns the operation corresponding to the selected operation mode to the operation unit, and transmits an operation signal from the operation unit to the mobile crane, wherein when the operation mode is selected, an operating range of a boom that can be performed from the remote operation terminal is limited to a limited movable range corresponding to the selected operation mode and set in the mobile crane, and wherein in the selected operation mode, the limited movable range is smaller than an operation range of the boom in which instruction can be performed from a cab operation device of the mobile crane.

2. The remote operation terminal according to claim 1, wherein the control unit assigns only the operation corresponding to the operation mode selected by the mode selection unit, to the operation unit.

3. The remote operation terminal according to claim 1, wherein the plurality of operation modes have an on-tire operation mode corresponding to work performed by the mobile crane in an on-tire state, and a jack-up operation mode corresponding to work performed by the mobile crane in a jack-up state.

4. The remote operation terminal according to claim 3, wherein, in the on-tire operation mode, the operation unit can instruct the mobile crane on the operation, within a smaller operation range than the jack-up operation mode.

5. The remote operation terminal according to claim 1, wherein the plurality of operation modes include a crane mode in which operation required for suspended loading work can be operated.

6. The remote operation terminal according to claim 1, wherein the plurality of operation modes include an outrigger mode in which operation required for overhanging and storage of an outrigger included in the mobile crane can be operated.

7. The remote operation terminal according to claim 1, wherein the plurality of operation modes include a jib-set mode in which operation required for overhanging and storage of a jib included in the mobile crane can be operated.

8. A remote operation system of a mobile crane comprising:

a mobile crane including a boom;

a remote operation terminal comprising:

a mode selection unit that can select an operation mode corresponding to work of the mobile crane from a plurality of operation modes;

an operation unit for instructing the mobile crane on operation; and a control unit that, when the operation mode is selected by the mode selection unit, transmits the signal indicating the operation mode selected by the mode selection unit to the mobile crane, assigns the operation corresponding to the selected operation mode to the operation unit, and transmits an operation signal from the operation unit to the mobile crane;

an overload prevention device that is provided in the mobile crane, has a plurality of limited movable ranges, and sets the operating range of the boom to the limited movable range corresponding to an operation mode corresponding to the signal received from the remote operation terminal, wherein when the operation mode is selected in the remote operation terminal, an operating range of the boom that can be performed from the remote operation terminal is limited to a limited movable range corresponding to the selected operation mode, and wherein in the selected operation mode, the limited movable range is smaller than an operation range of the boom in which instruction can be performed from a cab operation device of the mobile crane.

9. The remote operation system of a mobile crane according to claim 8, wherein, when an operation mode is selected by the mode selection unit of the remote operation terminal, the overload prevention device sets the operation range of the boom to a limited movable range corresponding to the operation mode selected by the mode selection unit.

* * * * *